US006683286B2

(12) United States Patent
Ulrich

(10) Patent No.: US 6,683,286 B2
(45) **Date of Patent: *Jan. 27, 2004**

(54) METHOD AND APPARATUS FOR PRODUCING POWER FOR INDUCTION HEATING WITH BUS BARS COMPRISED OF PLATES

(75) Inventor: Mark Ulrich, New London, WI (US)

(73) Assignee: Illinois Tool Works Inc., Glenview, IL (US)

( * ) Notice: Subject to any disclaimer, the term of this patent is extended or adjusted under 35 U.S.C. 154(b) by 90 days.

This patent is subject to a terminal disclaimer.

(21) Appl. No.: 10/004,050

(22) Filed: Oct. 19, 2001

(65) Prior Publication Data

US 2002/0036200 A1 Mar. 28, 2002

Related U.S. Application Data

(60) Continuation of application No. 09/574,872, filed on May 19, 2000, now Pat. No. 6,316,755, which is a division of application No. 08/893,354, filed on Jul. 16, 1997, now Pat. No. 6,124,581.

(51) Int. Cl.[7] ..... H05B 6/08
(52) U.S. Cl. ..... 219/665; 219/661; 363/74
(58) Field of Search ..... 219/665, 660, 219/661, 666, 608, 778, 779, 663; 323/247, 328; 363/74, 21

(56) References Cited

U.S. PATENT DOCUMENTS

| | | | | |
|---|---|---|---|---|
| 3,475,674 A | | 10/1969 | Porterfield et al. | |
| 3,735,089 A | * | 5/1973 | Sciaky | 219/87 |
| 3,816,690 A | | 6/1974 | Mittelmann | |
| 3,878,619 A | * | 4/1975 | Hodgett et al. | 34/1 |
| 4,092,509 A | | 5/1978 | Mitchell | |
| 4,465,920 A | | 8/1984 | Hoyt, Jr. et al. | |
| 4,714,808 A | * | 12/1987 | Brolin | 219/617 |
| 4,769,754 A | | 9/1988 | Reynolds et al. | |
| 4,870,248 A | | 9/1989 | Gilliland et al. | |
| 4,897,775 A | | 1/1990 | Klaassens et al. | |
| 5,010,471 A | | 4/1991 | Klaassens et al. | |
| 5,075,836 A | | 12/1991 | Suzuki et al. | |
| RE33,866 E | | 3/1992 | Schutten et al. | |
| 5,248,866 A | | 9/1993 | Tanaka et al. | |
| 5,270,914 A | | 12/1993 | Lauw et al. | |
| 5,343,023 A | | 8/1994 | Geissler | |
| 5,504,309 A | | 4/1996 | Geissler | |
| 6,316,755 B1 | * | 11/2001 | Ulrich | 219/665 |

FOREIGN PATENT DOCUMENTS

| | | | |
|---|---|---|---|
| GB | 2 146 186 | * | 4/1985 |
| GB | 2284077 | | 5/1995 |
| WO | WO 09559 | | 4/1994 |

OTHER PUBLICATIONS

M. Kim, M. Youn, "An Energy Feedback Control of Series Resonant Converter," *IEEE Trans. on Power Elecs.*, vol. 6, No. 3, Jul. 1991, pp. 338–345.

R. Oruganti, et al., "Implementation of Optimal Trajectory Control of Series Resonant Converters," *IEEE Trans. on Power Elecs.*, vol. 3, No. 3, Jul. 1988, pp. 318–327.

R. Oruganti, F. Lee, "Resonant Power Processers: Part I–State Plane Analysis," *IEEE–IAS–1984 Annual Meeting*, Sep. 30–Oct. 4, 1984, pp. 860–867.

Microprocessor control of a transistorized induction heating power supply, Leisten et al., Nov. 1988, 9 pages.

* cited by examiner

*Primary Examiner*—Philip H. Leung
(74) *Attorney, Agent, or Firm*—George R. Corrigan

(57) ABSTRACT

An induction heating power supply is disclosed. It includes a power circuit having at least one switch and a power output. The output circuit includes an induction head. The output circuit is coupled to the power output. A controller has at least one feedback input connected to the output circuit, and has a control output connected to the switch. The controller predicts the switch zero crossing and preferably soft switches the switch. Current feedback is obtained from a coil placed between the bus bars. Each bus bar is comprised of multiple plates to increase current capacity.

20 Claims, 7 Drawing Sheets

METHOD AND APPARATUS FOR PRODUCING POWER FOR INDUCTION HEATING WITH BUS BARS COMPRISED OF PLATES

This is a continuation of, and claims the benefit of the filing date of, U.S. patent application Ser. No. 09/574,872, filed May 19, 2000, entitled Method And Apparatus For Producing Power For An Induction Heating System, which issued on Nov. 13, 2001 as U.S. Pat. No. 6,316,755, which is a divisional of U.S. patent application Ser. No. 08/893,354, filed Jul. 16, 1997, entitled Method and Apparatus For Producing Power For An Induction Heating Source, which issued on Sep. 26, 2000 as U.S. Pat. No. 6,124,581.

BACKGROUND OF THE INVENTION

1. Technical Field

The present invention relates generally to induction heaters and, in particular, to induction heating systems having switchable power supplies.

2. Background Art

Induction heating is a well known method for producing heat in a localized area on a susceptible metallic object. Induction heating involves applying an AC electric signal to a heating loop or coil placed near a specific location on or around the metallic object to be heated. The varying or alternating current in the loop creates a varying magnetic flux within the metal to be heated. Current is induced in the metal by the magnetic flux, thus heating it. Induction heating may be used for many different purposes including curing adhesives, hardening of metals, brazing, soldering, welding and other fabrication processes in which heat is a necessary or desirable agent or adjurant.

The prior art is replete with electrical or electronic power supplies designed to be used in an induction heating system. Many such power supplies develop high frequency signals, generally in the kilohertz range, for application to the work coil. Because there is generally a frequency at which heating is most efficient with respect to the work to be done, some prior art inverter power supplies operate at a frequency selected to optimize heating. Others operate at a resonant frequency determined by the work piece and the output circuit. Heat intensity is also dependent on the magnetic flux created, therefore some prior art induction heaters control the current provided to the heating coil, thereby attempting to control the heat produced.

One example of the prior art representative of induction heating system having inverters is U.S. Pat. No. 4,092,509; issued May 30, 1978, to Mitchell.

Another type of induction heater in which the output is controlled by turning an inverter power supply on and off is disclosed in the U.S. Pat. No. 3,475,674, issued Oct. 28, 1969, to Porterfield, et al. Another known induction heater utilizing an inverter power supply is described in U.S. Pat. No. 3,816,690, issued Jun. 11, 1974, to Mittelmann.

Each of the above methods to control power delivered by an induction heater either is not adjustable in frequency and/or does not adequately control the heat or power delivered to the workpiece by the heater. The prior art induction heaters described in U.S. Pat. Nos. 5,343,023 and 5,504,309 (assigned to the present assignee) provide frequency control and a way to control the heat or power delivered to the workpiece. These induction heating systems include an induction head, a power supply, and a controller. As used herein induction head refers to an inductive load such as an induction coil or an induction coil with matching transformer.

Some uses of induction heaters are to anneal, case harden, or temper metals such as steel in the heat treating industry. Also induction heaters are used to cure or partially cure adhesives that have metallic particles or are near a metallic part. During the induction heating process a workpiece or part has one or more induction heads placed around and/or in close proximity to the workpiece. Power is then provided to the induction heads, which heat portions of the part near the head, curing the adhesive, or annealing, case hardening, or tempering the part.

One type of power supply used in induction heating is a resonant or a quasi-resonant power supply. As used herein resonant power supply refers to both resonant and quasi-resonant power supplies. A resonant induction heating power supply has an output tank formed by the induction coil or induction head and a capacitor. Current is provided to the tank from a current source and current will circulate within the tank. The current from the current source replenishes the energy in the tank reduced by losses and energy transferred to the work piece. Generally, the tank current facilitates power to the head.

It is desirable in some ways to operate induction heaters at a high frequency output. A higher frequency output allows the magnetic components (inductors and transformers) to be smaller and lighter. This will make the power supply less costly.

The induction heating power supplies described in U.S. Pat. Nos. 5,343,023 and 5,504,309 have control circuitry that tracks the voltage of the resonant tank, and alternately fires opposite pairs of IGBT's that comprise a full bridge configuration as the tank voltage across the devices transitions through zero. This is an attempt at soft switching, but there is a delay in the control and gate drive circuitry that causes a delay (1.2 $\mu$sec e.g.) from the zero crossing until the IGBT turns on. Consequently, when the IGBT turns on, it hard switches into a positive value of voltage and current, and the switching losses become large.

The losses for this sort of power supply increase with frequency. First, as the frequency increases the number of switching events increase. Second, as the frequency increases the 1.2 $\mu$sec delay becomes a larger portion of the cycles, and the voltage into which the hard switch is made will be higher. For example, at 10 KHz the voltage will be about 7.5% of the peak after 1.2 $\mu$sec: At 50 KHz the voltage will be about 38% of the peak. Thus, the switching voltage is higher and the losses are higher. Finally, conduction losses are greater because the current is off during the 1.2 $\mu$sec. The peak current, and hence the RMS current, must be higher to compensate for the time the current is off. Because conduction losses increase with the square of the RMS current, the losses are greater. At higher frequencies 1.2 $\mu$sec is a larger portion of the cycle, hence the problem is exacerbated. In sum, higher frequency operation cause three problems: more loss events (more switching), higher losses for each event, and increased conduction losses.

Another prior art resonant power supply described in Chapter 2 of a PH.D. thesis by L. Grajales of Virginia Tech was designed to soft switch a transistor by starting the switching process at zero crossing and then holding the voltage or current, or both, to zero during the turning on and turning off of the transistor. However, this typically required holding the current and/or voltage at zero for a length of time while the switch is turned on. If the propagation delay when turning switches on and off is, for example, 1.2 $\mu$sec, this is about 2.4% of the cycle at 10 KHz, and is of little consequence. However, it is 12% of the cycle at 50 KHz. Thus, to obtain the desired average current the instantaneous current during the remaining 88% of the cycles must be higher. This requires a higher peak current. In other words, the current must be greater when the current is non-zero to compensate for time it is held to zero (12% at 50 KHz e.g.). This means the peak current is higher, which means the RMS current and losses will also be higher. Thus, soft switching increased conduction losses.

Because soft switching reduces the losses at turn on and turn off, at the expense of increased conduction loss (as described above), it is a design trade off in the Grajales method as to how much duty cycle may be sacrificed in order to achieve minimum switching losses. The practical limit occurs when the increased conduction losses exceed the reduced switching losses.

Accordingly, it would be desirable to provide an induction heating power supply that reduces switching losses without a corresponding increase in conduction losses. Preferably, this would be done by soft switching, or nearly soft switching, the switches used in the output tank. The soft switching will preferably be done by predicting zero crossing and starting the firing process before zero crossing.

The amount of energy delivered to the work piece by the head must be adequately controlled to properly treat the workpiece. This energy depends on, among other things, the energy delivered to the head, the losses in the head, and the relative position of the head to the workpiece (which affects coupling). Some prior art controllers used with inverter based power supplies measure the current delivered to the head. However, in resonant or quasi-resonant induction heaters the resonating current in the tank should be measured.

It is also desirable to be able to determine the tank current so that the user of the equipment knows how much current is flowing in the head and to prevent the capacitors which form the tank from being destroyed by to much current and/or voltage. The current from the current source replenishes the current in the tank due to losses and energy transferred to the work piece.

However, the tank current is High, (1000 amps e.g.) and, to accommodate such high currents, the bus bar through which the current flows is tall, for example a height of 6–18 inches. Thus, it is difficult to obtain current sensing device which will fit around the bus bar. Additionally, mechanical constraints may not allow much room between the bus bars. Accordingly, it would be desirable to have a device which allows current in a resonant tank used in a induction heater to be able to be sensed.

Typically, power supply bus bars (for high current applications) are thin metal plates. Copper bus bars that carry high amounts of current must have the capacity to carry the current without excessive losses (heating). Excessive losses reduce efficiency and increase resistance, thus further increasing losses. Generally, the reference depth and height of the copper plate bus bar determines losses. Thus, the current carrying capacity of a bus bar is increased by increasing its height.

Generally, copper plates have a current carry capacity of about 300 amps for every two inches of height at 60 Hz. However, at high frequencies, such as 50 Khz, the capacity is only about 100 amps per two inches of height. The reduced current capacity is largely due to changed reference depth (which depends on frequency). Thus, prior art 1000 amp induction heaters use a bus bar on the order of 18 inches high. This makes the case much larger than otherwise necessary. Other prior art induction heaters use two inch bus bars that are water cooled. This prevents over heating, but is very inefficient since the losses still occur: they are simply dissipated.

Thus, a bus bar for a 1000 amp induction heater that is efficient yet a reasonable height is desirable.

SUMMARY OF THE INVENTION

According to a first aspect of the invention an induction heating power supply includes a power circuit having at least one switch and a power output. An output circuit includes an induction head. The output circuit is coupled to the power output. A controller has at least one feedback input connected to the output circuit, and has a control output connected to the switch. The controller begins the switching process prior to the switch zero crossing. In one embodiment the switch is soft switched.

The power circuit is a resonant power supply and the output circuit includes a resonant tank in one embodiment.

Another embodiment provides that the controller includes a zero crossing detector coupled to the output circuit and a frequency detector coupled to the zero crossing detector. In one alternative the frequency detector includes a ramp and a reset coupled to a zero crossing detector.

Another embodiment provides that the controller includes an output voltage detector coupled to the output circuit. The controller includes a peak voltage detector coupled to the output circuit in an alternative. A comparator receives the peak voltage, the frequency signal, and the output voltage in another alternative.

The controller includes a current feedback signal input coupled to the output circuit in another embodiment. An error circuit receives the current feedback signal and produces an error output in response thereto. The error output is provided as an input to the comparator.

According to another aspect of the invention a resonant power supply comprises an output tank and at least two bus bars connected to the output tank. The bus bars are disposed with a gap therebetween. A coil is placed in the gap between the bus bars, and a feedback circuit is connected to the coil. Alternatives include a filter in the feedback circuit, integrating the feedback circuit output, or dividing the output by a signal dependent on the frequency. In another embodiment the bus bars are substantially parallel.

A third aspect of the invention is an induction heating power supply comprising an output circuit having first and second inputs. Two bus bars are connected to the inputs. The bus bars are comprised of a plurality of plates. In one alternative each plate has a capacitor connected to it.

Figure 1:
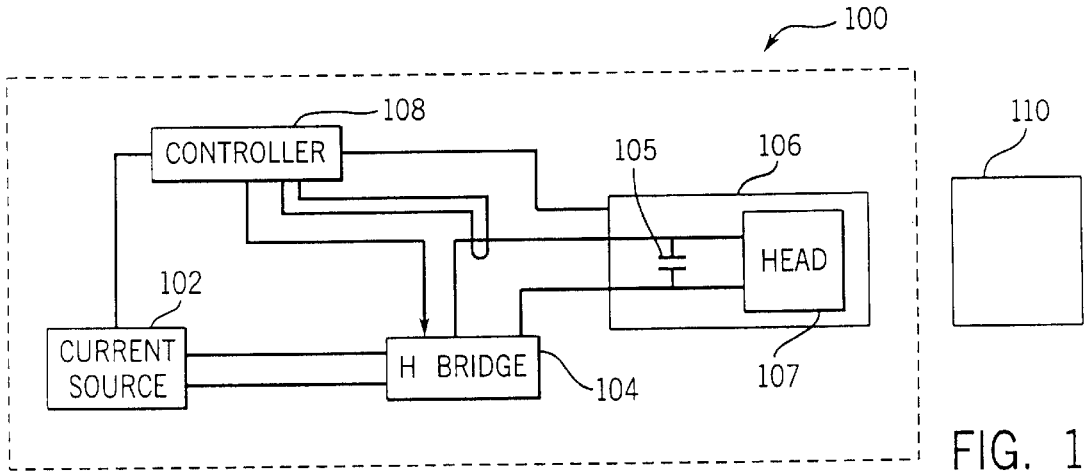
FIG. 1 is a block diagram of an induction heating system made in accordance with the present invention.

Other principal features and advantages of the invention will become apparent to those skilled in the art upon review of the following drawings, the detailed description and the appended claims.

DETAILED DESCRIPTION OF A PREFERRED EXEMPLARY EMBODIMENT

Before explaining at least one embodiment of the invention in detail it is to be understood that the invention is not limited in its application to the details of construction and the arrangement of the components set forth in the following description or illustrated in the drawings. Other circuits may be used to implement the inventing and the invention may be used in other environments.

A block diagram of an induction heater 100 constructed in accordance with the preferred embodiment is shown in FIG. 1. Induction heater 100 includes a current source 102, an H-Bridge circuit 104, an output tank 106, and a controller 108. Output tank 106 includes a capacitance 105 (which may be implemented by multiple capacitors) and an induction head 107. Induction head 107 is disposed near a workpiece 110.

Current source 102 provides current to H-Bridge 104. H-Bridge 104 provides current to output tank 106. The tank current circulates in capacitor 105 and induction head 107. The tank current in head 107 induces eddy currents in workpiece 110, thereby heating workpiece 110.

H-Bridge 104 resonates at a frequency dependent upon the load (size, shape, material and location of the workpiece e.g.) and the components of induction heater 100. The resonant frequency ranges from 10 KHz to 50 KHz in the preferred embodiment.

Controller 108 receives feedback signals that allow it to control the switches of H-Bridge 104 so that they are switched at zero volts. Controller 108 compensates for propagation delays in the logic and firing circuits by predicting when the zero crossing will occur. Specifically, controller 108 begins the firing or switching process about 1.2 microseconds before zero crossing in the preferred embodiment. The switching process includes the events that occur during the propagation delay.

Controller 108 predicts or anticipates the zero crossing using peak tank voltage, time since the previous zero crossing, average tank current and instantaneous tank current. Also controller 108 may control current source 102. The circuitry that anticipates the zero crossing will be described below. Induction heater 100 includes a bus bar that is small yet efficient. A current sensor cooperates with the bus bar to provide a tank current feedback signal.

Figure 2:
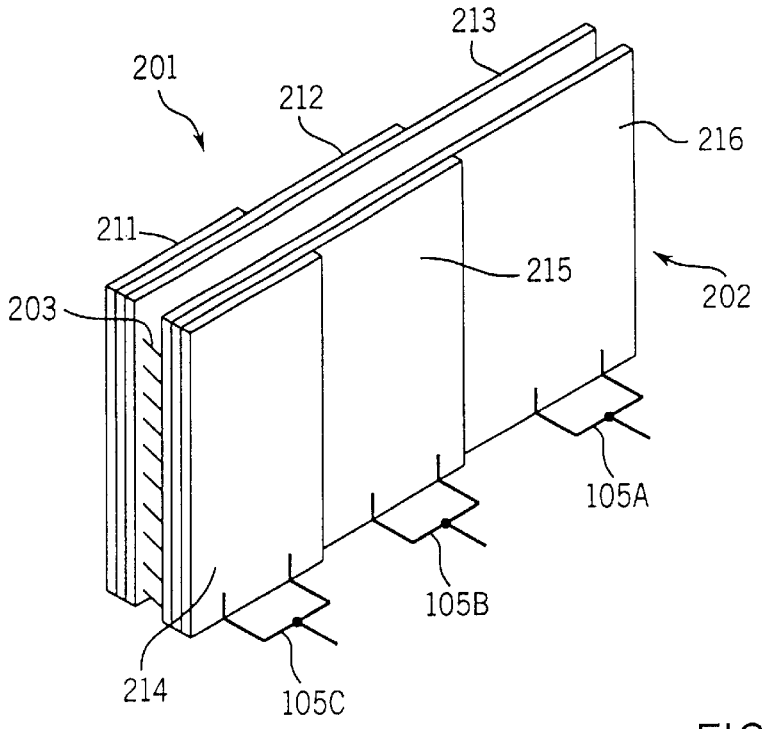
FIG. 2 is a perspective view of a bus bar and current sensor in accordance with the present invention.
Figure 4:
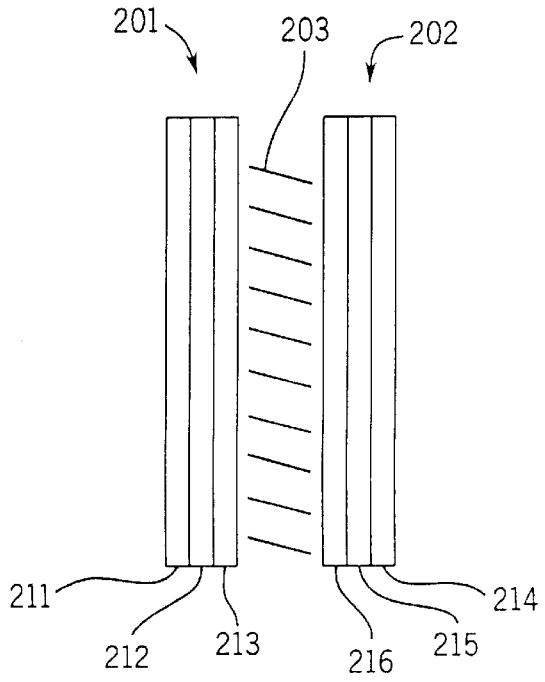
FIG. 4 is a side view of a bus bar and current sensor in accordance with the present invention.
Figure 3:
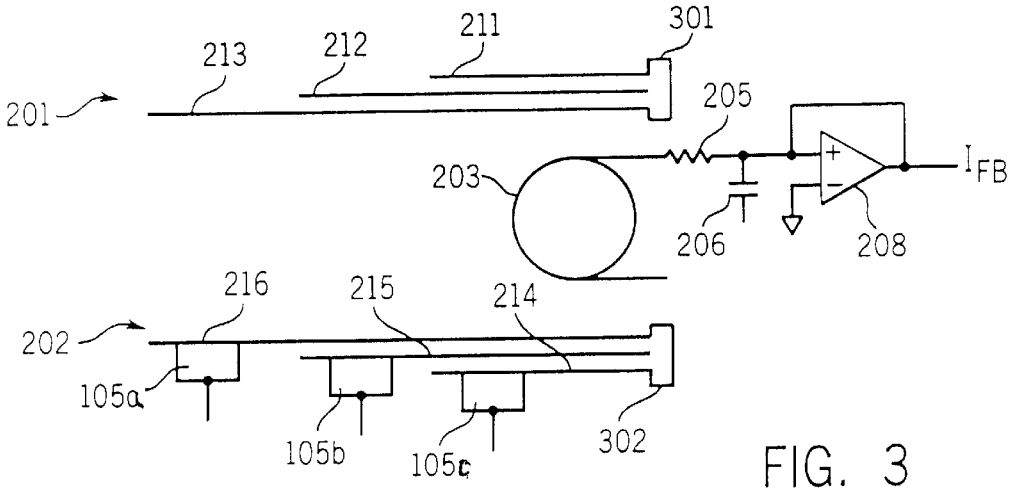
FIG. 3 is a top view of a bus bar and current sensor in accordance with the present invention.

Referring now to FIGS. 2–4 an arrangement which allows the current in the output tank 106 to be sensed as shown. A pair of substantially parallel copper bus bars 201 and 202 are arranged in a parallel fashion. Bus bar 202 is attached to capacitance 105 (which is 3 capacitors 105A–105C in the preferred embodiment). A coil 203 is placed between bus bars 201 and 202. Coil 203 has a width substantially equal to (slightly less than) the separation between bus bars 201 and 202.

Alternative embodiments entail a narrower coil than the distance between bus bars 201 and 202. Coil 203 is placed such that current from each of capacitors 105 will flow past the coil, thereby inducing voltage in the coil. Specifically, coil 203 is placed near the end of bus bars 201 and 202 that are attached to connectors 301 and 302 (FIG. 3). All current flowing into the bus flows through connectors 301 and 302, and thus past coil 203.

Coil 203 is connected to a resistor 205 and a capacitor 206. The voltage on coil 203 is proportional to the current which flows in bus bars 201 and 202 (as will be described in detail below). An op amp 208 is connected between the node common to resistor 205 and capacitor 206. Op amp 208 is configured to be a unity gain voltage follower, which isolates the voltage at the node common to resistor 205 and capacitor 206. Resistor 205, capacitor 206 and op amp 208 may be located on the control board (although they do not need to be). Thus, the output voltage of the filter is proportional to the tank current.

Coil 203 operates as follows: When current flows in the parallel plates that are bus bars 201 and 202 the current induces a magnetic field between the plates. The magnitude of the magnetic field is proportional to the current (assuming the dimensions the plates are much greater than the separation of the plates). Using known equations such as $B=\mu_0{}^*I_0$, or the Biot-Savart law, the magnetic field may be calculated. The magnetic flux $\Phi$ created by B can be given by, $\Phi=\S B\cdot dS$.

For a coil of simple geometry inserted between the current carrying plates and oriented along the induced magnetic field, the flux in the coil is given by, $\Phi=\mu_0{}^*I_0{}^*A$, where A=vector normal to the cross-sectional area of the coil with magnitude equal to the area of the coil. Current flowing in the coil is time varying and it will induce a time varying magnetic field. Therefore, from Faraday's Law of Induction, a voltage will be induced in the coil with a value of: $E=-d\Phi/dt$. Taking the Fourier transform shows that the voltage induced in the coil is proportional to the current flowing in the plates and the frequency at which the current is alternating.

The frequency dependence can be removed by integrating, using a low-pass filter or dividing the signal from the coil by a signal proportional in amplitude to the frequency of the current flowing in the plates. The filter of FIG. 2 is used in the preferred embodiment. Thus, the output voltage of the filter is proportional to the tank current. This method of obtaining the tank current can be extended to other geometries besides parallel plates by determining the magnetic field between the two current carrying conductors. Other geometries can be used by an analytical solution of the equations, computer simulation or calibration of the actual hardware used (i.e. empirical testing).

Bus bars 201 and 202 are comprised of three plates, 211–216 (FIGS. 2–4) in the preferred embodiment. Each plate carries one-third of the total current. Using three plates allows the bus bar to be relatively short (about 6 inches in the preferred embodiment) and do not need water cooling.

Plate 215 is connected to and carries the current from capacitor 105B. Plate 214 is connected to and carries the current from capacitor 105C. Plate 216 is connected to and carries the current from capacitor 105A. Plates 214–216 are connected to connecter 302. Thus, each plate carries ⅓ of the total current, and the height of each plate is ⅓ of the height of a single plate having the combined current capacity of the three plates. A similar arrangement is used with plates 211–213. This arrangement avoids excessive losses (and the result needed for water cooling) and undesirable high bus bars.

Figure 5:
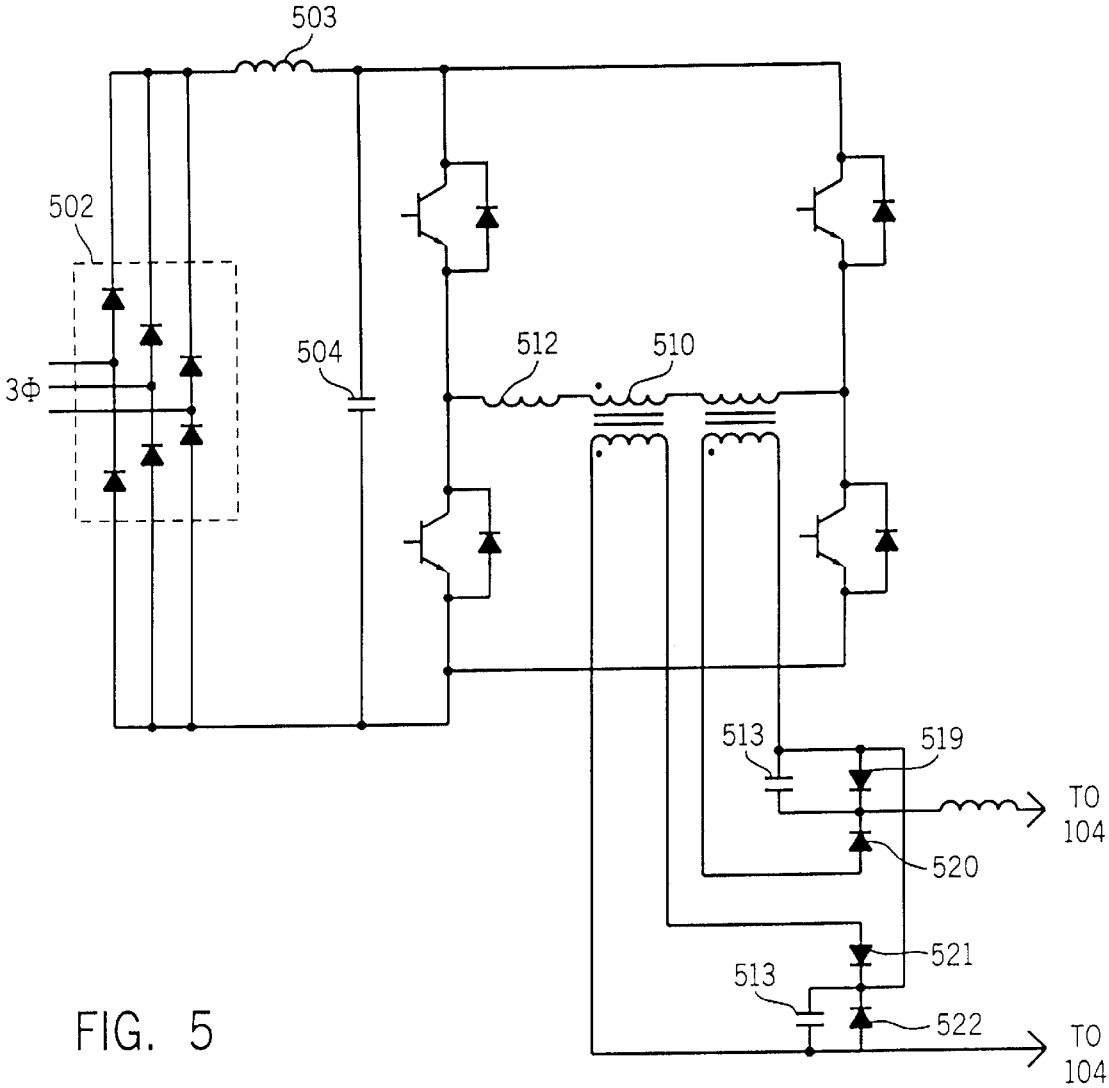
FIG. 5 is a circuit diagram of the current source of FIG. 1.

Current source 102 is shown in detail in FIG. 5, and includes an input rectifier 502 which may be connected to a three phase power source. Input rectifier 502 preferably includes 6 diodes arranged in a typical fashion. Input rectifier 502 is connected to an inductor 503 (0.001 H) which feeds an H bridge comprised of switches 506, 507, 508 and 509. The switches in the H bridge are preferably IGBT's, however other switches may be used. A capacitor 504 (0.0012 F) is provided across the H bridge to filter the voltage provided through inductor 503 from rectifier 502. The center leg of the H bridge includes the primary windings of a transformer 510 and an inductor 512. The secondary windings of transformer 510 are connected through rectifying diodes 519–522 to inductor 524. Capacitors 513 and 514 (1.5 $\mu$F) are provided across diodes 519 and 522, respectively. Capacitors 513 and 514 resonate with inductor 512 in a manner known in the art. The output current source 102 is provided to resonant circuit 104.

Figure 6:
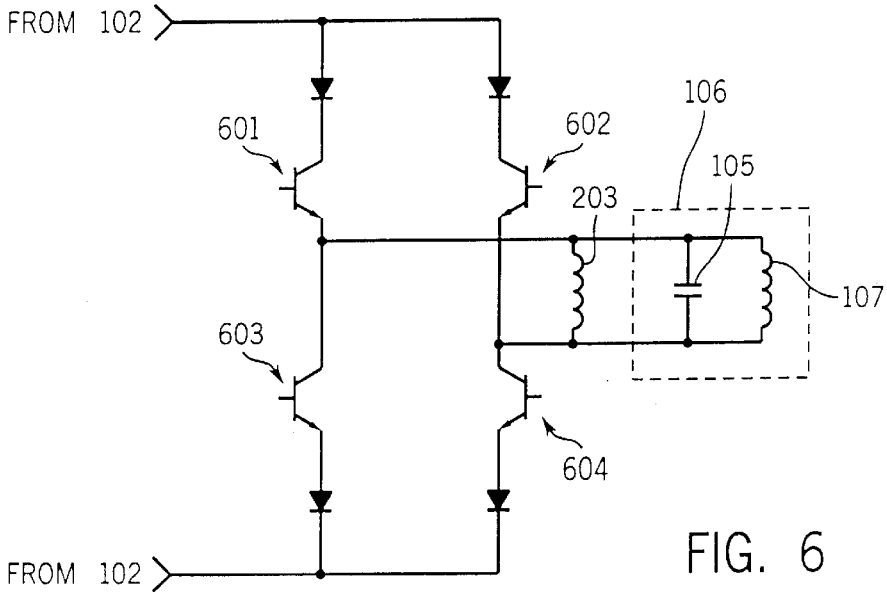
FIG. 6 is a circuit diagram of the H-Bridge of FIG. 1.

H-Bridge 104 shown in detail in FIG. 6 and includes IGBT's 601–604. Each IGBT has a diode associated therewith. IGBT's 601–604 are arranged in an H bridge. Tank circuit 106, including capacitor 105 (1.5 $\mu$F) and induction head 107 is disposed in the center leg of the H bridge. The H bridge is switched on and off in a known fashion but early enough to be zero voltage switched, such that current is provided to the tank circuit and losses are kept low. Switches 601–604 maybe switches other than IGBT's.

Generally, the prior art compared the tank voltage to zero volts, and began firing when the tank voltage (which is sinusoidal) crossed zero. According to the present invention, the process to turn IGBT's 601–604 on begins at a time before the tank voltage crosses zero such that after the propagation delay the tank voltage is (or has not yet crossed) zero.

Specifically, the present invention includes an induction heating power supply with a resonant tank output circuit. The resonant tank circuit is fired in such a way as to reduce switching losses, preferably soft switching the switches, which are IGBT's in the preferred embodiment. The tank voltage is equal to the switch voltage in the configuration of the preferred embodiment. The control circuitry predicts when the zero crossing (i.e. zero volts and/or current across the switch) will be, and the transistors are turned on in anticipation of the tank voltage (which is also the switch voltage in the preferred embodiment) passing through zero. Thus, the transistors are turned on, or have just turned on, when the voltage transitions through zero, thereby providing a soft switch (or they turn on to low voltage reducing switching losses). Because the voltage at the turn on is zero, virtually all of the available duty cycle may be used thereby minimizing the peak transistor currents and conduction losses.

Reduced losses are obtained when switching at or near zero power across the switch. Zero power across the switch is obtained by having zero volts and/or zero current across the switch. Zero crossing, as used herein, refers to zero power across the switch. The configuration of the preferred embodiment uses a tank wherein the tank voltage is equal to the switch voltage. Thus, zero crossing for the switch occurs when there is a tank zero crossing. Other configurations will not have a tank voltage equal to the switch voltage.

The present invention anticipates the zero crossing by adding (or subtracting) an offset to the tank voltage which corresponds to an earlier time of 1.2 $\mu$sec. This sealed value is used, in part, to determine the offset from zero crossing. At a given frequency a given percentage of the peak voltage will correspond to 1.2 $\mu$sec. Thus, the peak tank voltage is scaled to give an appropriate value.

However, the frequency of the tank is not fixed, but depends on the load. The percentage of the peak that corresponds to 1.2 $\mu$sec at 10 KHz corresponds to much less time at higher frequencies (for a given peak voltage) then at lower frequencies. Thus, the frequency is also used to determine the offset.

The instantaneous frequency must be determined fast enough to avoid added propagation delay. Accordingly, the preferred embodiment uses a time measured from the last zero-crossing, which is proportional to 1/frequency. This value is linearly scaled, and subtracted from the scaled peak value. Thus, the result is an offset that increases as the peak voltage increases, and decreases as time increases, (or frequency decreases).

The tank voltage is sinusoidal (non-linear), and the scaling of the frequency (time) feedback is linear. Thus, an error will be introduced. Other errors result from heating, non-linearities, etc. The error is compensated for by a circuit which "nudges" or adjusts the offset. The amount of adjusting may be determined empirically. The preferred embodiment adjusts the offset sufficiently to provide true soft switching. Alternatives include predicting zero crossing and switching into a very low voltage, or almost soft switching.

The offset is adjusted by comparing the instantaneous current to the average current in the preferred embodiment. When the instantaneous current is excessively greater than the average current (50% e.g.) the offset is reduced. This results in a firing that provides the desired soft switching. Also, the prior art firing system (i.e. begin firing at zero crossing) may be included as a back-up so that the firing process begins no later than at zero crossing.

Figure 7:
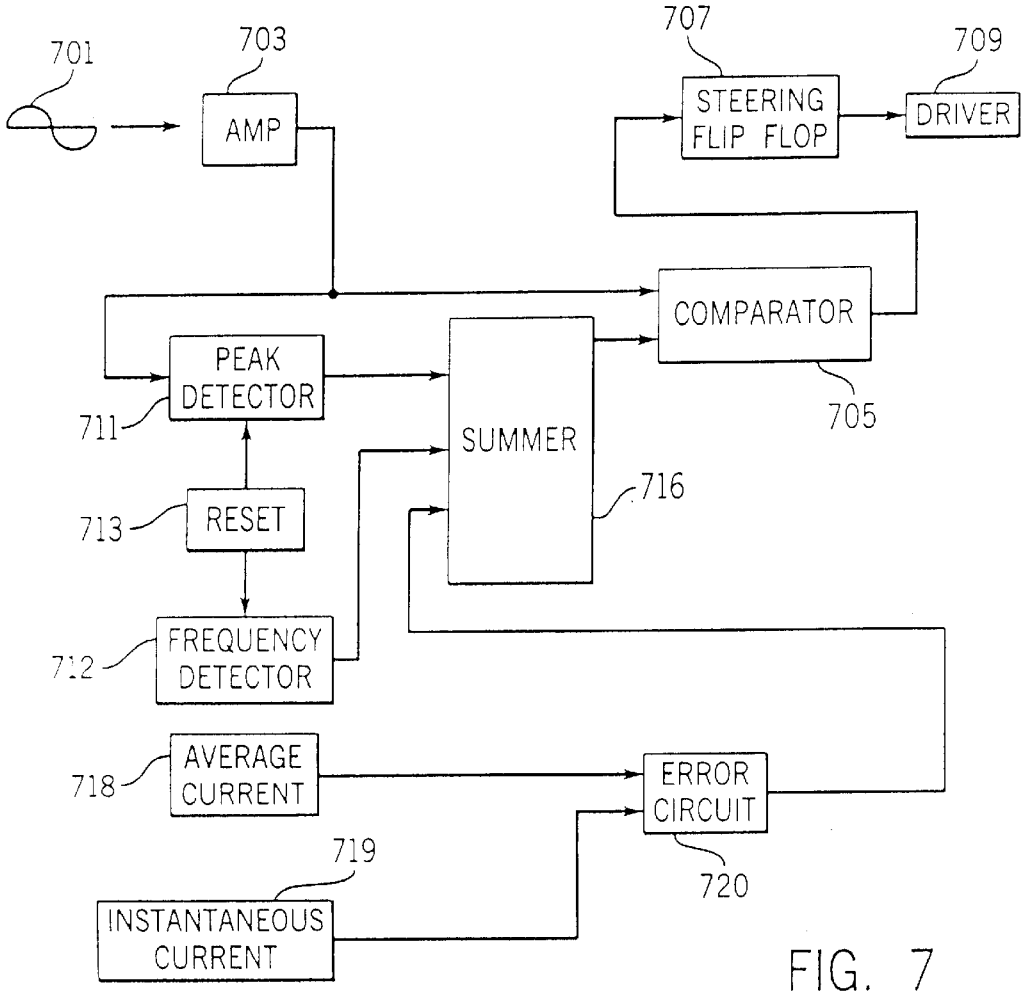
FIG. 7 is a block diagram of the controls of FIG. 1.

FIG. 7 is a block diagram of the preferred embodiment of the firing control of the IGBT's in accordance with the preferred embodiment. Waveform 701 represents the voltage on tank 106. The instantaneous tank voltage is amplified by a differential amplifier 703 and fed to a comparator 705 (with an offset as described below). Comparator 705 compares the voltage feedback to a value representative of zero volts from the tank. The output of the comparator is provided to a steering flip flop circuit 707 who's output is, in turn, provided to a gate driver 709.

The present invention provides an additional input into comparator 705 that causes the firing process to begin before zero crossing, so that the IGBTs are on at zero crossing. Specifically, the voltage feedback signal is also provided to a peak detector 711. Peak detector 711 samples the feedback voltage, and detects the peak. The output of a reset circuit 713 is provided to peak detector 711 after each zero crossing and causes it to be reset.

A frequency detector 712 provides an output that ramps up with time, at a constant slope. The ramp is reset by reset circuit 713 at each zero crossing. Thus, the output of frequency detector 712 is proportional to the length of time-since the last zero crossing, or 1/f of the tank voltage. Both of these signals (from peak detector 711 and from frequency detector 712) are provided to a summing circuit 716. The frequency and peak signals are combined to form the offset (from zero crossing) which is adjusted by an error circuit 720.

A feedback signal indicative of the average of the tank current is provided by average current circuit 718 to error circuit 720. Also, a signal indicative of instantaneous current is provided by a current circuit 719 to error circuit 720. The current feedback signals are obtained using a current transformer measuring the current provides by current source 102 (not the tank current).

Error circuit 720 provides a signal based upon the current feedback to summing circuit 716 and adjusts the offset. The output of summing circuit 716 offsets the tank voltage signal at which the firing of the IGBT's begins about 1.2 μsec before zero-crossing.

The voltage is monitored in the preferred embodiment by a circuit that tracks the voltage in the resonant tank and feeds the peak and zero crossing detectors. When a zero crossing is detected, the reset circuit releases the peak detector and frequency detector circuits. As the voltage tracks to its maximum amplitude, the peak detector tracks along with it. When the peak is attained, a diode holds the voltage level on the capacitor at the level until it is reset.

The frequency detector circuit consists primarily of a current source feeding a capacitor and a field effect transistor (FET) for reset in the preferred embodiment. When the reset is released, the current source begins charging the capacitor in a linear fashion; therefore the voltage across the capacitor is directly proportional to the length of time the capacitor has been charging. Since the time is equal to 1/frequency, the voltage is also proportional to frequency.

The two voltages are scaled and then summed with the tank voltage feedback signal as described above. As the sum passes through the zero threshold, the comparator changes state causing the timer to deliver a pulse to the gate drive circuitry.

After the tank voltage passes through zero, the zero crossing detector changes state and turns on the reset of the FETs. The voltage levels of the peak detector and frequency are held at zero until the next zero crossing causes the FETs to be turned off and the cycle starts over.

Figure 8:
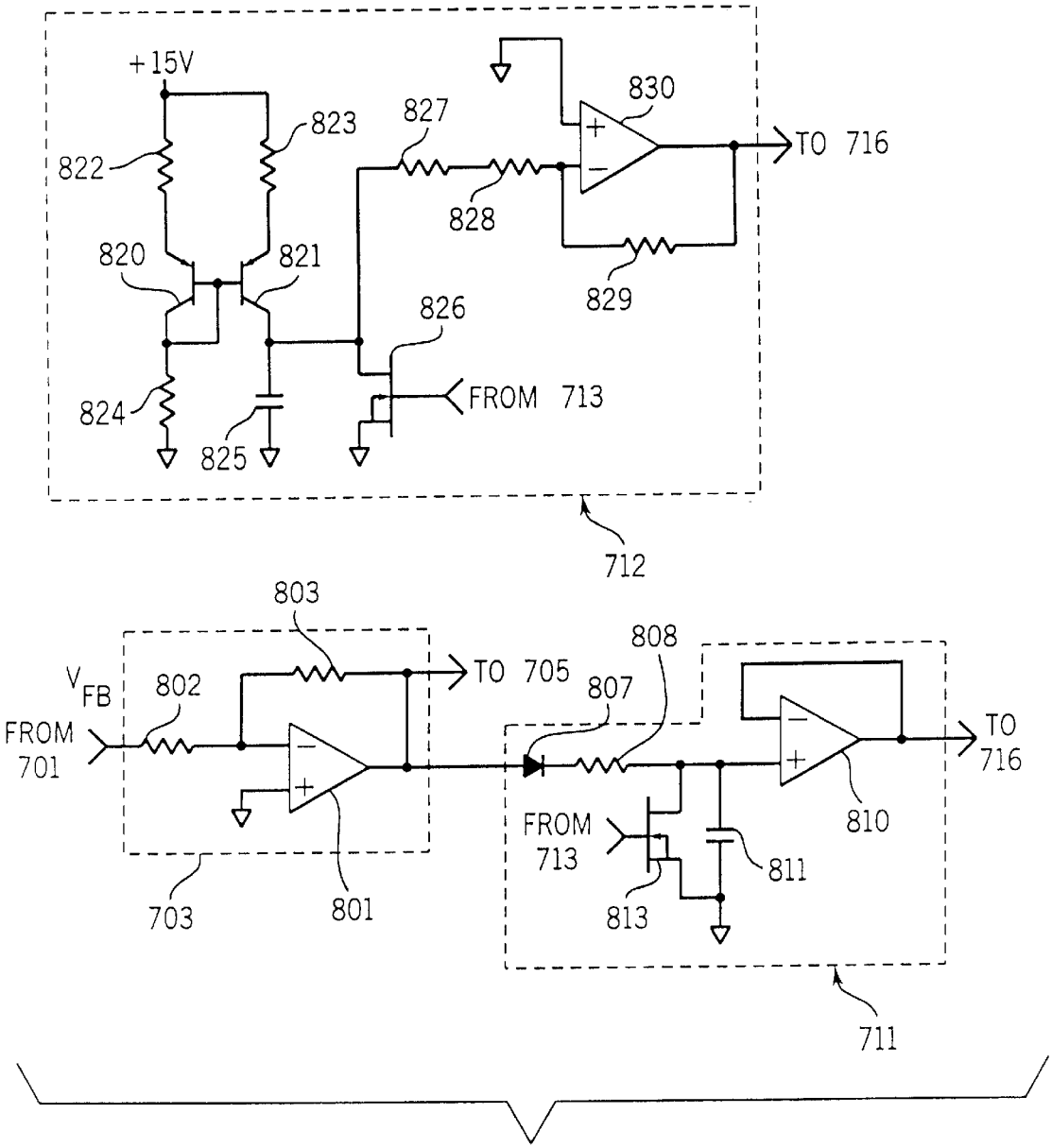
FIGS. 8–10 are circuit diagrams of the controller of FIG. 1.
Figure 9:
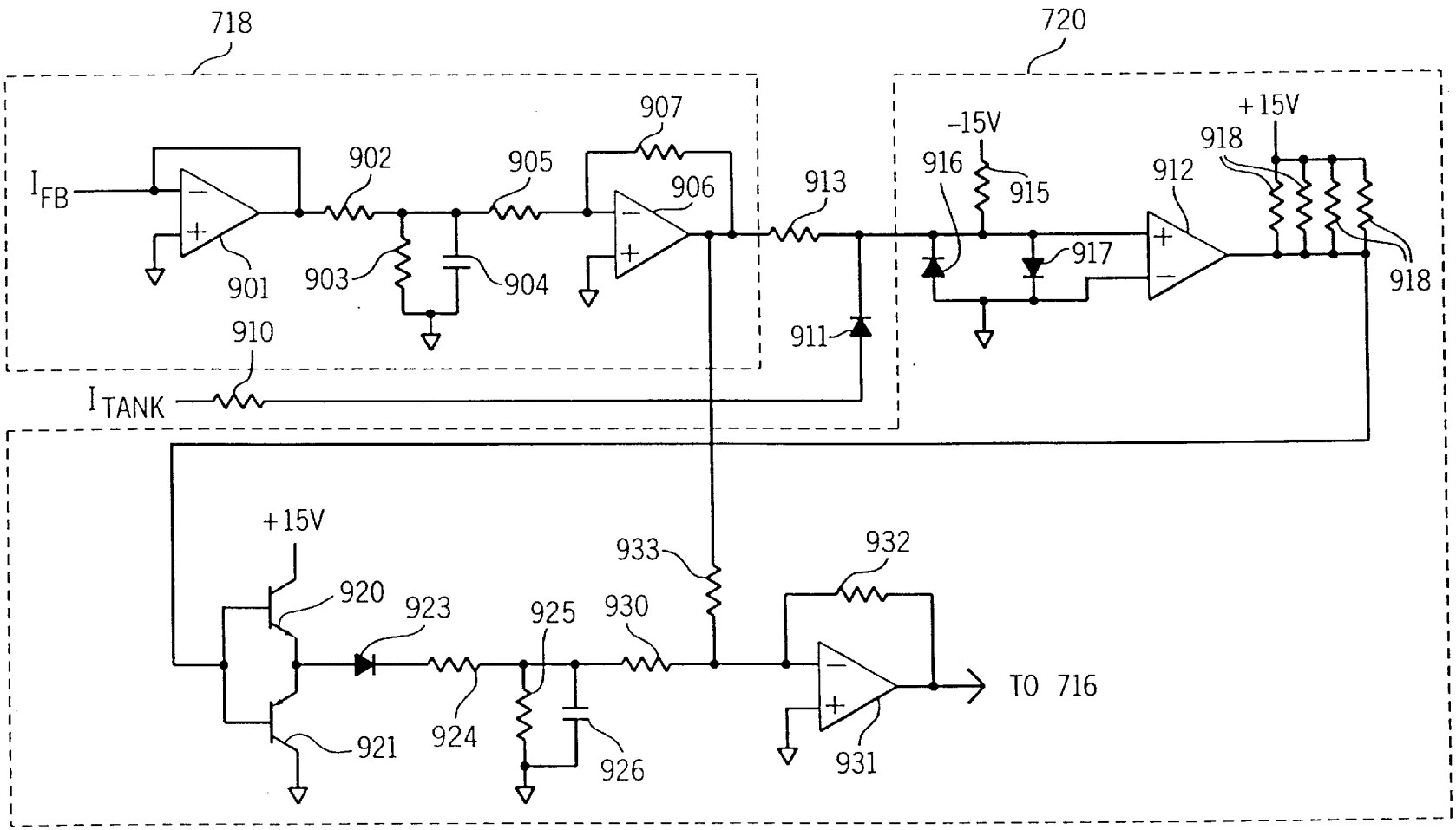
Figure 10:
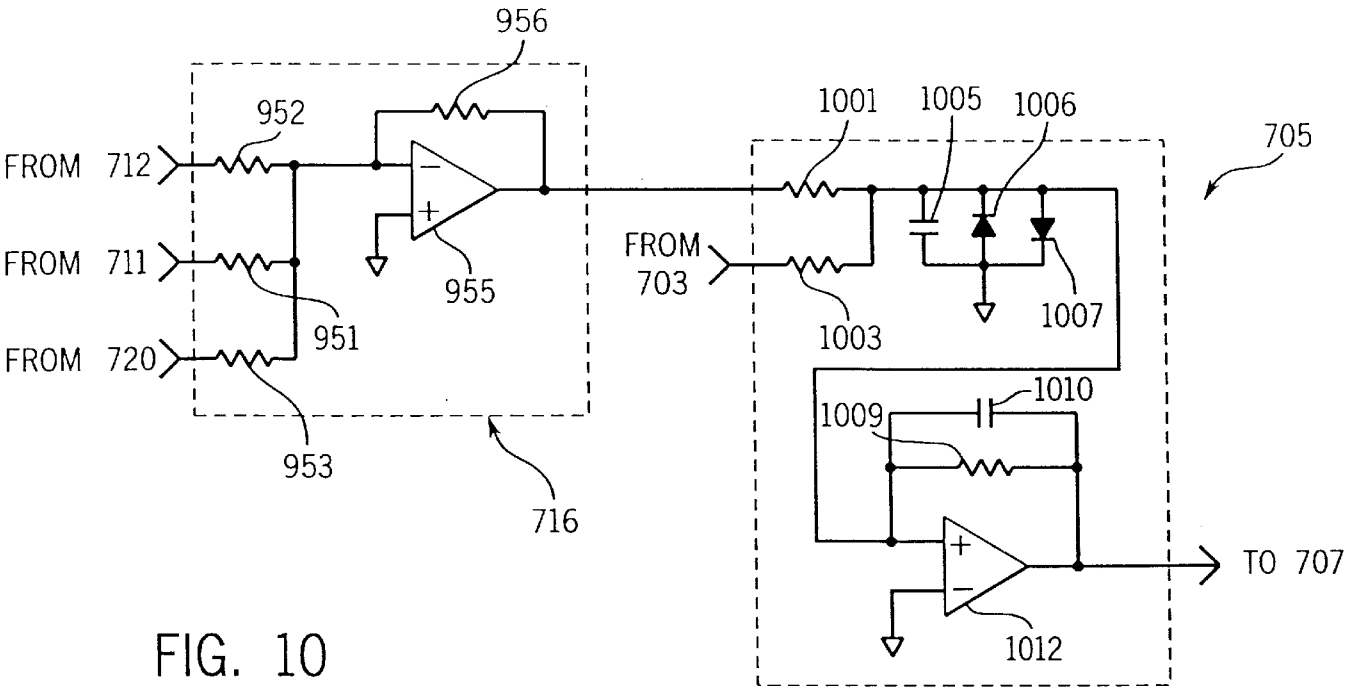

The detailed circuitry which implements the preferred embodiment is shown on FIGS. 8–10. As one skilled in the art will readily recognize other circuitry may be used to implement these control functions, including other analog or digital circuits.

The voltage feedback signal from tank 106 is provided as $V_{FB}$ (FIG. 8). $V_{FB}$ is provided to an op amp 801 which includes feedback resistors 802 (10K ohm) and 803 (10K ohm). Op amp 801 is configured to scale the voltage feedback signal, and is part of amplifier 703. The output of output op amp 803 is provided to comparator 705.

The output of op amp 801 is also provided to peak detector 711. Peak Detector 711 includes a diode 807 and a resistor 808 (100 ohms), through which $V_{FB}$ is provided to a unity gain op amp 810. The voltage feedback signal is also provided through resistor 808 to a capacitor 811 (0.001 μf), and the peak of the voltage signal is held by capacitor 811. Thus, the output of op amp 810 corresponds to the tank voltage peak.

A switch 813 is connected in parallel with capacitor 811 and has its gate connected to reset circuit 713. Reset circuit 713 causes switch 813 to turn on, shorting capacitor 811 at zero crossing. Thus, sample and hold circuit 711 samples the feedback voltage signal, detects the peak, and stores that peak. The output of op amp 810 (the peak tank voltage) is provided to summing circuit 716.

Frequency detector 712 includes a pair of transistors 820 and 821. Transistors 820 and 821 are connected to a +15 volt supply through a pair of resistors 822 and 823 (47.5 ohms). The gates of transistor 820 and 821 are connected through a resistor 824 (30.1 K ohms) to ground. The output of transistor 821 is connected to a capacitor 825 (0.0022 microfarad). The voltage on capacitor 825 will depend upon the length of time it has been charging.

A switch 826 is provided in parallel with capacitor 825 and is used to short capacitor 825. The gate of transistor 826 is connected to reset circuit 713 and upon a reset signal (triggered by a zero crossing) switch 826 will be turned on, and capacitor 825 will be short circuited, and thus its voltage will be reset to zero.

Thereafter, the voltage will continue to increase until the next resetting. The voltage on capacitor 825 is thus proportional to the length of time between zero crossings, and thus proportional to 1/f. The output of capacitor 825 is provided through a resistor 827 (1K ohm) to an inverting op amp 830. Inverting op amp 830 inqludes feedback resistors 828 and 829 (100K ohms). Thus, the output of op amp 830 is a negative voltage proportional to 1/f of the tank circuit. The output of op amp 830 is provided to summing circuit 716.

Average current circuit 718, instantaneous current circuit 719 and error circuit 720 are shown in FIG. 9. A feedback current signal $I_{FB}$ is provided to the average current circuit 718 which includes and op amp 901 (which buffers and inverts the current feedback signal). The output of op amp 901 is provided through a resistor 902 (1K ohm) to a parallel combination of a resistor 903 (11.1K ohm) and a capacitor 904 (10 microfarad). Resistor 903 and 904 are also connected to ground and the output of capacitor 904 represents the average current (averaged over about 100 cycles as set by the RC time constant). The output of capacitor 904 is provided to an op amp 906 through a resistor 905 (20K ohm) and a feedback resistor 907 (20K ohm). Thus, the output of op amp 906 corresponds to the average dc current.

A signal indicative of the tank instantaneous current, $I_{TANK}$, is provided through a resistor 910 (2k ohm) and a diode 911 (which protects the $I_{TANK}$ signal) to a comparator 912. The average dc current is also provided through a resistor 913 (2K ohm) to comparator 912. A negative 15 volt signal (current source) is provided through a resistor 915 (100K ohm). Also, comparator 912 has on its inputs a pair of diodes 916 and 917 which protect the inputs to comparator 912. Comparator 912 is configured to provide a high output when the instantaneous DC current exceeds the average DC current by more than 50%.

A +15 voltage source and resistors 918 (2K ohm) provide current to comparator 912. The output of comparator 912 is provided to the gates of a pair of transistors 920 and 921. Transistors 920 and 921 are connected to a 15 volt supply. The common junction of transistors 920 and 921 is provided through a diode 923 and a resistor 924 (1K ohm) to a capacitor 926 (0.1 microfarad). A resistor 925 (100K ohm) is provided in parallel a with capacitor 926 and both are connected to ground at one end. Thus, when transistors 920 and 921 are turned on by comparator 912, current is provided to capacitor 926, which integrates that current. The current is provided when the instantaneous current exceeds the average current by more than 50%. The output of capacitor 926 is provided through a resistor 930 (100k ohm) to an op amp 931. Op amp 931 also receives the dc current signal through a resistor 933 (100K ohms). Op amp 931 includes a feedback resistor 932 (100K ohm). The output of op amp 931 is provided to summing circuit 716.

Error circuit 720 is a circuit which adjusts by small amounts the threshold set in response to the frequency and peak voltage. Thus, the output of current circuit 720 is provided to summing circuit 716 along with the peak voltage and frequencies.

Summing circuit 716 includes a resistor 951 (16.2K ohms) connected to peak detector 711, a resistor 952 (43.2K ohm) connected to frequency detector 712, and a resistor 953 (20K ohm) connected to error circuit 720 (FIG. 8). Each of these resistors, in turn, is connected to an op amp 955, which includes a feedback resistor 956 (10K ohm). Op amp 955 and the associated resistors serve to scale and sum the various feedback signals. The output of op amp 955 is the adjusted offset to the tank voltage, and provided to comparator 705.

The output of summing circuit 716 is provided through a resistor 1001 (10K ohms) to a summing comparator 1012, which are part of comparator 705. The voltage feedback signal is provided through a resistor 1003 (12.1K ohms) also to comparator 1012. Comparator 1012 is configured as a summing comparator and includes a capacitor 1010 (100 picofarads) and a resistor 1014 (498k ohm) that adds hysteresis. A diode 1006 and a diode 1007 hold the inputs of comparator 1012 to acceptable levels. A capacitor 1005 (47 picofarads) filters the various inputs to comparator 1012. The output of comparator 705 is provided to steering flip flop circuit 707, which operates in a conventional manner.

Steering flip flop 707 selects the earlier of the prior art zero crossing detection or the inventive prediction of zero crossing. The IGBT's are turned on at the earliest of the two. Thus, in the event the prediction circuit fails to operate properly, the control reverts to the prior art type of control.

Alternative embodiments include predicting the zero crossing by firing a preset or determined amount of time after the previous zero crossing. Even though this is firing after a previous zero crossing, it is still before (and thus predicting) the next zero crossing. The time can be determined using average or instantaneous frequency, or by adjusting the time based on a previous error. Another alternative uses a fixed threshold to find a "prior-to-zero" crossing, and firing at that time. This method also predicts the zero crossing. Also, the RMS voltage could be used instead of the peak voltage to predict zero crossing.

Figure 11:
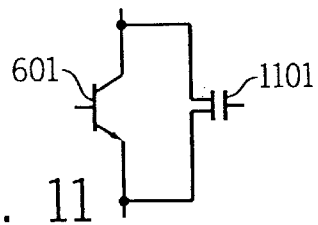
FIG. 11 is a circuit diagram of an alternative embodiment.

Another alternative is shown in FIG. 11. One of the IGBT's, 601, from the H-Bridge is shown (without an anti-parallel diode). A switch 1101, such as an FET, is in parallel with switch 601. Switch 1101 is a very fast (100 nsec., e.g.), lower (than switch 601) amperage switch. Switch 1101 is fired such that when switch 601 begins to turn on, switch 1101 is already on and holds the voltage across switch 1101 to close to zero. Thus, switch 601 is soft switched. Because switch 1101 is very fast it may be fired at zero crossing with very little loss. Alternatively, switch 1101 may be predictively fired in accordance with the prediction techniques described above. Another alternative is to fire switches 601 and 1101 together. Again switch 1101 turns on quickly, holding the voltage across switch 601 close to zero, thus providing a soft switch. After switch 601 is on, switch 1101 is turned off. Switch 1101 carries very little current and switches into low voltage since it is so fast. For example, a 100 nsec switching time is only one percent of a half-cycle at 50 kHz.

Each of the embodiments described above may be carried out using a dual arrangement (a voltage source and firing on zero current crossing e.g.).

Thus, the present invention includes an induction heating power supply with a resonant tank output circuit. The resonant tank circuit is fired in such a way as to reduce switching losses, preferably soft switching the switches, which are IGBT's in the preferred embodiment. The control circuitry predicts when the zero crossing (i.e. zero volts and/or current across the switch) will be, and the transistors are turned on in anticipation of the tank voltage passing through zero. Thus, the transistors are already on when the voltage transitions through zero thereby providing a soft switch (or they turn on to low voltage reducing switching losses). Because the voltage at the turn on is zero virtually all of the available duty cycle may be used, thereby minimizing the peak transistor currents and conduction losses.

Thus, it may be seen that the present invention as described provides a method and apparatus to provide power for induction heating, and the power circuit is soft switched to reduce switching losses. Also, a bus bar that reduces size and losses is provided. A current feedback circuit is used to determine the tank voltage.

The invention is capable of other embodiments or being practiced or carried out in various ways, and it should be understood that the preferred embodiments are but one of many embodiments. Also, it is to be understood that the phraseology and terminology employed herein is for the purposes of description and should not be regarded as limiting.

What is claimed is:

1. A power supply for providing power that may be provided to an induction coil for induction heating, comprising:

an output circuit having first and second inputs on which it receives power;

a first bus bar electrically connected to the first input; and a second bus bar electrically connected to the second input;

wherein the first bus bar is comprised of a first plurality of plates and the second bus bar is comprised of a second plurality of plates; and wherein the first plurality of plates are fixed in position with respect to one another, and the second plurality of plates are fixed in position with respect to one another, and the first plurality of plates is fixed in position with respect to the second plurality of plates.

2. The power supply of claim 1, further comprising an output tank, wherein the first and second bus bars are connected to the output tank.

3. The power supply of claim 2, wherein the first and second bus bars are disposed with a gap therebetween.

4. The power supply of claim 3, further comprising a coil disposed in the gap, thereby having a voltage induced therein by a current flow in the bus bars.

5. The power supply of claim 4, further comprising a feedback circuit connected to the coil, and a controller disposed to control the current in the output tank, and connected to the feedback circuit.

6. The apparatus of claim 5 wherein the feedback circuit includes a filter.

7. The apparatus of claim 1 wherein the first and second bus bars are substantially parallel.

8. An method of providing power capable of being used in induction heating, comprising:

receiving inputs power on a first bus bar and a second bus bar;

wherein the first bar is comprised of a first plurality of plates and the second bus bar is comprised of a second plurality of plates;

fixing the position of the first plurality of plates with respect to one another;

fixing the position of the second plurality of plates with respect to one another;

fixing the position of the first plurality of plates with respect to the second plurality of plates; and providing output power.

9. The method of claim 8, further providing an output tank and connecting the first and second bus bars to the output tank.

10. The method of claim 9, further comprising providing a gap between the first and second bus bars.

11. The method of claim 10, further comprising disposing a coil in the gap, and thereby inducing a voltage therein by a current flow in the bus bars.

12. The method of claim 11, further comprising providing feedback of the voltage.

13. The method of claim 12, further comprising controlling the current in the output tank in response to the feedback.

14. A power supply for providing power that may be provided to an induction coil for induction heating, comprising:

an output circuit having first and second inputs on which it receives power;

a first bus bar means for receiving the first input, wherein the first bar means is comprised of a first plurality of plates;

a second bus bar means for receiving the second input; and, wherein the second bus bar means is comprised of a second plurality of plates;

means for fixing the position of the first plurality of plates position with respect to one another;

means for fixing the position of the second plurality of plates position with respect to one another; and means for fixing the position of the first plurality of plates position with respect to the second plurality of plates.

15. The power supply of claim 14, further comprising an output tank, wherein the first and second bus bar means are connected to the output tank.

16. The power supply of claim 15, wherein the first and second bus bar means are disposed with a gap therebetween.

17. The power supply of claim 16, further comprising a coil means, disposed in the gap, for inducing a voltage therein by a current flow in the bus bars.

18. The power supply of claim 17, further comprising a feedback means for providing feedback from the coil means, and connected to the coil means, and a controller means for controlling the current in the output tank, and connected to the feedback means.

19. The apparatus of claim 18 wherein the feedback means includes a filter.

20. The apparatus of claim 19 wherein the first and second bus bar means are substantially parallel.

* * * * *